US006948343B2

(12) United States Patent
Williamson

(10) Patent No.: US 6,948,343 B2
(45) Date of Patent: Sep. 27, 2005

(54) AMMUNITION CAN LOCK ADAPTER

(76) Inventor: Robert J. Williamson, 262 Brentwood Way, Goleta, CA (US) 93117

( * ) Notice: Subject to any disclaimer, the term of this patent is extended or adjusted under 35 U.S.C. 154(b) by 30 days.

(21) Appl. No.: 10/717,411

(22) Filed: Nov. 18, 2003

(65) Prior Publication Data

US 2004/0107745 A1 Jun. 10, 2004

Related U.S. Application Data

(60) Provisional application No. 60/427,368, filed on Nov. 19, 2002.

(51) Int. Cl.[7] ..... E05B 65/48

(52) U.S. Cl. ..... 70/2; 70/63; 70/158

(58) Field of Search ..... 70/2–13, 229, 70/230, 63, 158

(56) References Cited

U.S. PATENT DOCUMENTS 2,705,575 A * 4/1955 Hammer ..... 220/849
3,157,040 A * 11/1964 Raye ..... 70/57
3,922,893 A * 12/1975 Berg ..... 70/13
4,308,733 A * 1/1982 Tampa ..... 70/259
4,601,618 A * 7/1986 McEldowney ..... 408/1 R
4,751,833 A * 6/1988 Stumpf, Jr. ..... 70/259
6,082,601 A * 7/2000 Standish ..... 224/569
6,193,449 B1 * 2/2001 Diaz ..... 408/115 R

* cited by examiner

*Primary Examiner*—John B. Walsh
(74) *Attorney, Agent, or Firm*—Felix L. Fischer

(57) ABSTRACT

A lock adapter for an ammunition can having a clamp lever with an aperture includes a rod element received through the aperture and mounted to a side of the can. The rod element incorporates a relieved portion on an end opposite the side of the can and has a length and diameter sized in combination with the relieved portion for clearance of the aperture through an angular displacement of the clamp lever for opening the can. A hole substantially perpendicular to an axis of the rod receives a padlock. A bolt received through a drilled hole in the side of the can engages a tapped bore in the rod. A Bellville washer is placed on the bolt between the side of the can and the head of the bolt. The Bellville washer includes a sealing gasket adjacent the side of the can to seal the bolt and bolt hole preventing moisture from entering the can.

7 Claims, 4 Drawing Sheets

AMMUNITION CAN LOCK ADAPTER

REFERENCES TO RELATED APPLICATIONS

The present application claims priority of the provisional application having Ser. No. 60/427,368 filed on Nov. 19, 2002 entitled 'AMMO CAN', LOCK ADAPTER.

BACKGROUND OF THE INVENTION

1. Field of the Invention

This invention relates generally to the field of security locking systems and, more particularly, to a padlock receiver system adapted for new manufacture or retrofit to ammunition cans employing the preexisting aperture and latching mechanism of the can to allow securing the ammunition can with a lock to prevent access to stored ammunition.

2. Description of the Related Art

Ammunition cans are readily available as surplus items or from various manufacturers. Typically, the can is of a standard design having a rectangular case with a hinged lid and a clamp lever engaging the lid opposite the hinge. Such ammunition cans usually do not have a locking mechanism to prevent entry into the can. Various locking mechanisms have been employed to lock ammunition cans including a standard hinged hasp arrangement which can be mounted with one element on the clamp lever and the mating hasp on the side of the can below the seated position of the clamp lever. This requires drilling of multiple holes for mounting of the elements on the clamp and side and often does not create a secure closure when locked.

Alternatively, bar clamp arrangements such as that marketed by Amherst Drop Zone, Inc. Hadley, Mass. attempt to lock the clamp lever with a bar attached in a cantilevered fashion from one end. Such devices may permit excessive play in the "locked" clamp lever allowing the clamp lever to be forced open without disengaging the lock.

It is therefore desirable to provide a locking mechanism which is easily retrofitted to existing ammunition cans without requiring excessive modification or drilling of mating holes on the can.

It is further desirable that the installed locking mechanism be secure to avoid disengagement of the locking mechanism.

SUMMARY OF THE INVENTION

The present invention provides a lock adapter for an ammunition can having a clamp lever with an aperture. The adapter includes a rod element received through the aperture and mounted to a side of the can. The rod element incorporates a relieved portion on an end opposite the side of the can and has a length and diameter sized in combination with the relieved portion for clearance of the aperture through an angular displacement of the clamp lever for opening the can. The rod element further has a hole substantially perpendicular to an axis of the rod and spaced from a butting surface on the rod engaging the side of the can for clearance of the clamp lever, the hole of predetermined size to receive a padlock. A bolt received through a drilled hole in the side of the can engages a tapped bore in the rod. A Bellville washer is placed on the bolt between the side of the can and the head of the bolt. The Bellville washer includes a sealing gasket adjacent the side of the can to seal the bolt and bolt hole preventing moisture from entering the can.

An embodiment which demonstrates the characteristics of the invention is set forth in the following detailed description. The embodiment, both as to its construction and its method of operation, together with additional advantages thereof, will be best understood from the following description when read and understood in connection with the accompanying drawings.

DETAILED DESCRIPTION OF THE INVENTION

Figure 1:
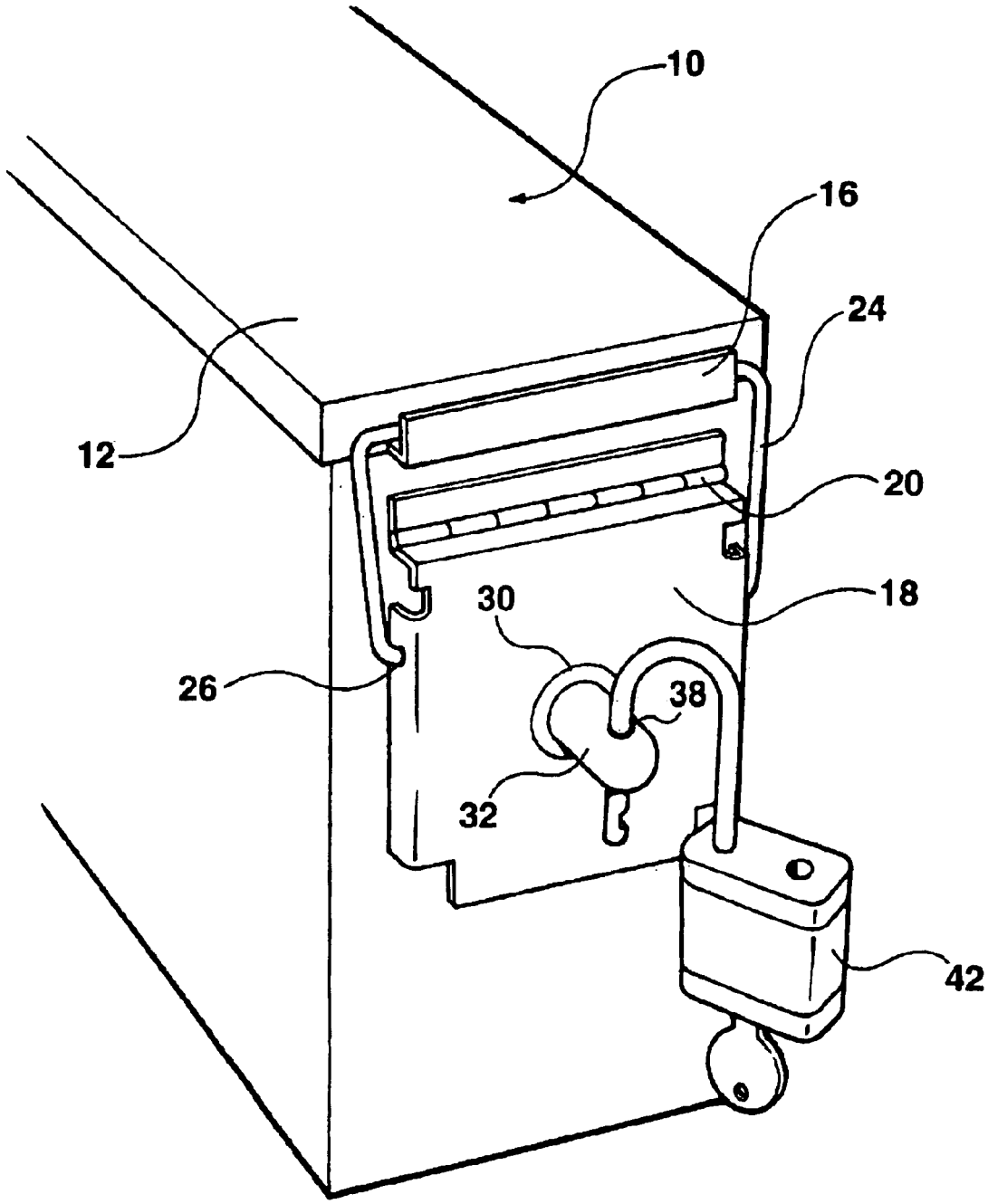
FIG. 1 is a partial perspective view of a standard ammunition can with a lock adapter employing the present invention installed.
Figure 2:
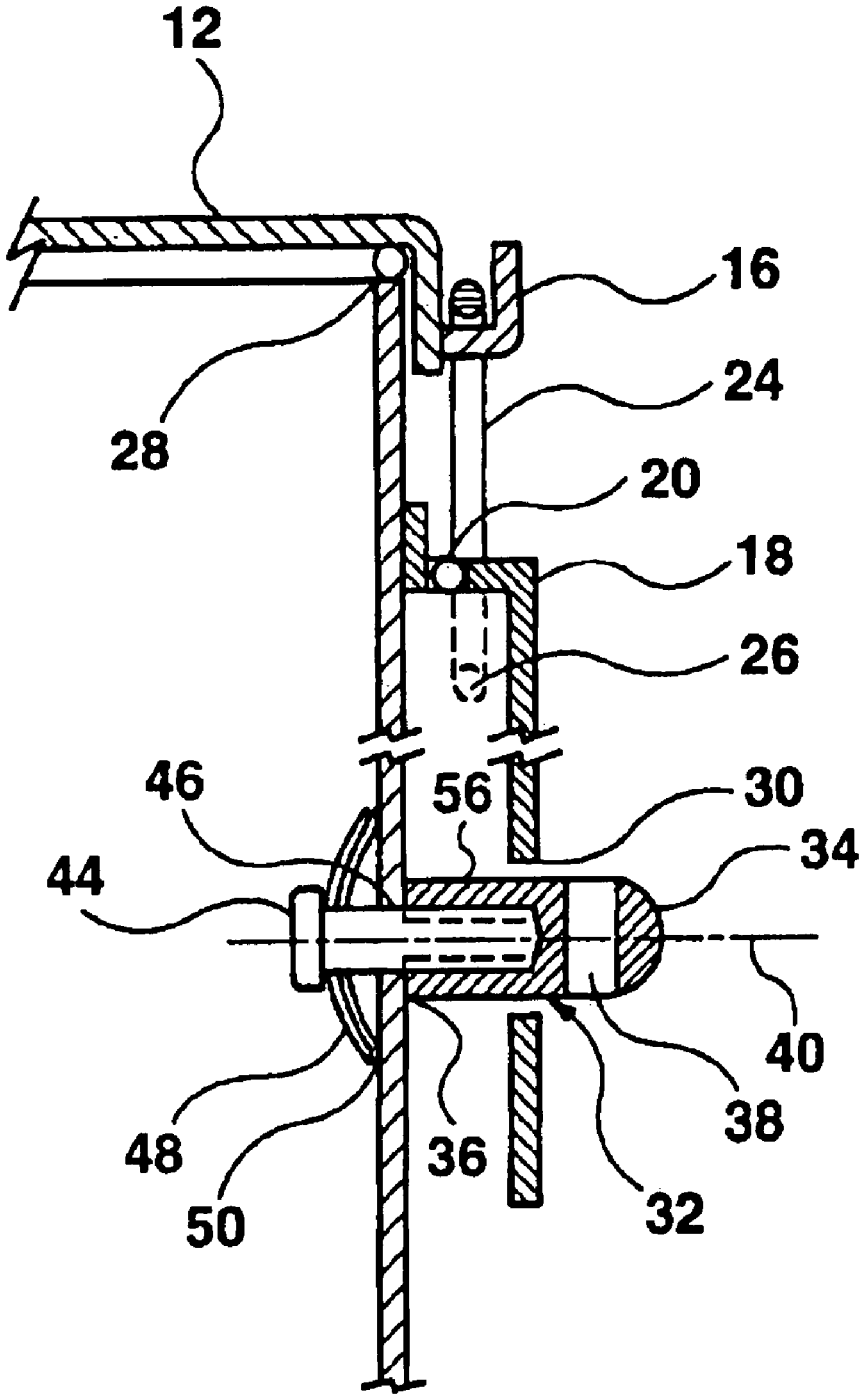
FIG. 2 is a side sectional view of the elements of the invention and partial section of the ammunition can.
Figure 3A:
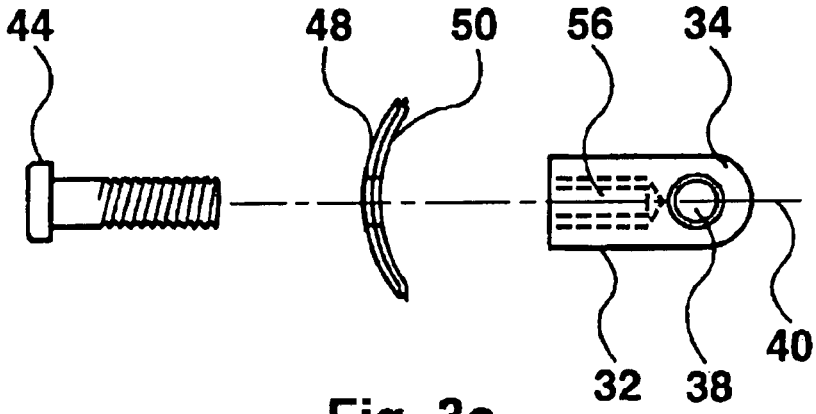
FIG. 3*a* is an exploded top view of the rod element, washer and bolt of FIG. 2.

Referring to the drawings, FIG. 1 shows a standard ammunition can 10 on which the present invention is mounted. The lid of the can 12 has a hinge (not shown) on one edge and a lip 16, best seen in FIG. 2, on a side opposite the hinge. A clamp lever 18 has a hinge 20 mounted to a side 22 of the can. A bale 24 which extends from the clamp lever at pivot points 26 and is received over the lip on the lid. The resilience of a seal 28 on the can lid and the over-center action of the bale urge clamp lever against the side of the can in the closed position.

Figure 3B:
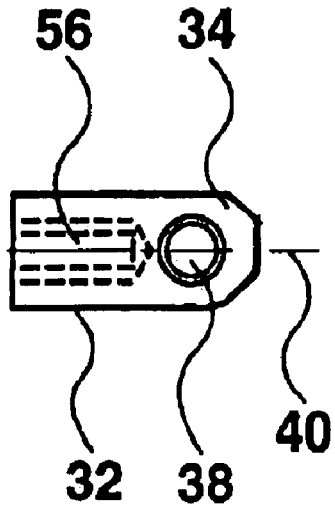
FIG. 3*b* shows an alternative embodiment of the rod element with a chamfered end.
Figure 3C:
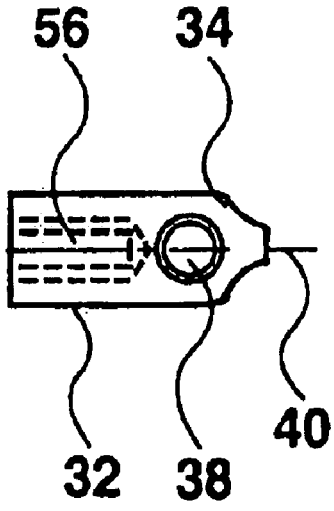
FIG. 3*c* shows a second alternative embodiment of the rod element with a filleted end; and, FIG. 4 is a partial side sectional view of the ammunition can with the drill guide in place.

On standard ammunition cans, the clamp lever has an aperture 30 which is typically merely a lightening hole, nominally ½ inch in diameter. The present invention employs a rod element 32 mounted to the side of the can and received through the aperture when the clamp lever is in the closed position. The rod element in the embodiment shown is substantially cylindrical with a diametrically relieved portion 34 at an end of the rod element distal from a butt surface 36 engaging the side of the can. For the embodiment shown the relieved portion is spherical but in alternative embodiments is chamfered or filleted as shown in FIGS. 3*b* and 3*c*. While the embodiments show a cylindrical rod element, a square or polygonal element is employed in alternative embodiments. The length and diameter of the rod element and the relief are sized to allow the rod element to be received through the aperture during the angular displacement of the clamp lever about its hinge. For the embodiment shown, the rod element is brass and employs a diameter of 7/16 inch with an overall length of 15/16 inch.

A hole 38 extends perpendicular to the axis 40 of the rod element to receive a padlock 42. For the embodiment shown, the hole is placed 11/16 inch from the butt surface engaging the side of the can and is a 3/16 inch hole with a deburred edge.

The rod element is mounted to the can side using a bolt 44 extending through a drilled hole 46 with a Bellville washer 48 having a sealing gasket 50 to secure the bolt and prevent moisture penetration in to the ammunition can. The Bellville washer is mounted either on the inside, as shown in the drawings, or outside of the can.

Figure 4:
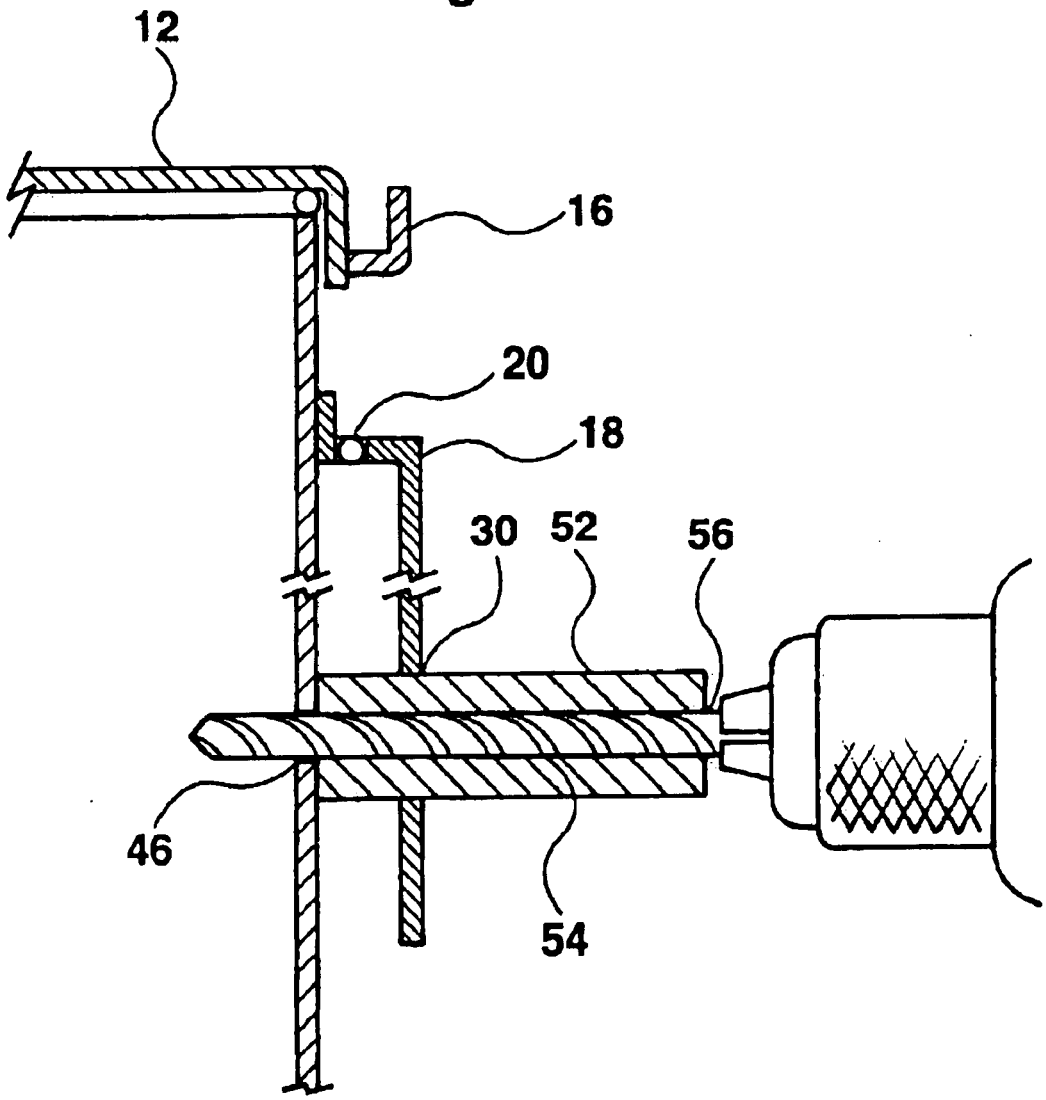

The adapter employing the present invention requires only one hole has to be drilled in the can side. Drilling of the hole is enabled using a drill guide or template ferule 52 as shown in FIG. 4. The template ferule has an outer diameter substantially equal to the diameter of aperture 30 in the clamp lever and an axial hole 54 sized to receive a ¼ inch drill bit 56. The template ferule is placed in the aperture and a drill bit is inserted through the axial hole to match drilled bolt hole 46 in the side of the ammunition can. The match drilled hole provides proper placement of the rod element for clearance from the aperture during operation of the clamp lever. For the embodiment shown, the bolt hole is concentric with the aperture. In alternative embodiments, the bolt hole is offset upward from the center of the aperture to provide greater clearance for the lower arc of the aperture from the rod element during rotation of the clamp lever. The bolt is inserted through the Bellville washer and the hole from inside the can and the rod element engages the bolt in a bore 56 which is tapped for the thread of the bolt. For the embodiment of the invention shown in the drawings, a ¼-20 NC2 bolt and taped thread are employed.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A lock adapter for an ammunition can having a clamp lever with an aperture, the adapter comprising:

a rod element received through the aperture and mounted to a side of the can, the rod element having a relieved portion distal the side of the can and a length and diameter sized in combination with the relieved portion for clearance of the aperture through an angular displacement of the clamp lever for opening the can, the rod element further having a hole substantially perpendicular to an axis of the rod and located distal a butting surface on the rod engaging the side of the can, the hole of predetermined size to receive a padlock; and a bolt received through a drilled hole in the side of the can and engaging a tapped bore in the rod.

2. A lock adapter for an ammunition can as defined in claim 1 further comprising:

a Bellville washer received on the bolt intermediate the side of the can and a head of the bolt.

3. A lock adapter for an ammunition can as defined in claim 2 wherein the Bellville washer includes a sealing gasket adjacent the side of the can.

4. A lock adapter for an ammunition can having a clamp lever with an aperture, the adapter comprising:

a substantially cylindrical rod element received through the aperture and mounted to a side of the can, the rod element having a spherically relieved portion distal the side of the can and a length and diameter sized in combination with the relieved portion for clearance of the aperture through an angular displacement of the clamp lever for opening the can, the rod element further having a hole substantially perpendicular to an axis of the rod and located intermediate a butting surface on the rod engaging the side of the can and a second end of the rod element, the hole of predetermined size to receive a padlock;

a bolt received through a drilled hole in the side of the can and engaging a tapped bore in the rod; and, a Bellville washer received on the bolt intermediate the side of the can and a head of the bolt, the Bellville washer includes a sealing gasket adjacent the side of the can.

5. A method for securing an ammunition can having a clamp lever with an aperture, the method comprising the steps of:

drilling a bolt hole in a side of the can adjacent to and collinear with the aperture;

mounting a rod element received through the aperture to a side of the can by boring and tapping a bore in the rod sized to receive a bolt;

inserting a bolt through the bolt hole into the bore in the rod;

tightening the bolt to secure the rod to the side of the can, the rod element having a relieved portion distal the side of the can and a length and diameter sized in combination with the relieved portion for clearance of the aperture through an angular displacement of the clamp lever for opening the can, the rod element further having a hole substantially perpendicular to an axis of the rod and located distal a butting surface on the rod engaging the side of the can, the hole of predetermined size to receive a padlock; and inserting a padlock through the hole in the rod element.

6. A method for securing an ammunition can as defined in claim 5 wherein the step of mounting further comprises the step of:

inserting the bolt through a Bellville washer prior to inserting the bolt through the bolt hole.

7. A method for securing an ammunition can as defined in claim 6 wherein the Bellville washer includes a sealing gasket and the step of inserting the bolt further comprises the step of:

aligning the Bellville washer with the bolt hole with the sealing gasket in contact with the side of the can.

* * * * *